US008406648B2

(12) United States Patent
Tsukioka

(10) Patent No.: US 8,406,648 B2
(45) Date of Patent: Mar. 26, 2013

(54) HEATING DEVICE, FIXING DEVICE, AND IMAGE FORMING APPARATUS

(75) Inventor: Yasutada Tsukioka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 12/923,473

(22) Filed: Sep. 23, 2010

(65) Prior Publication Data

US 2011/0097098 A1 Apr. 28, 2011

(30) Foreign Application Priority Data

Oct. 26, 2009 (JP) ..... 2009-245040

(51) Int. Cl.
*G03G 15/20* (2006.01)

(52) U.S. Cl. ..... 399/69; 219/619; 399/328

(58) Field of Classification Search ..... 399/69, 399/328; 219/619, 216
See application file for complete search history.

(56) References Cited

U.S. PATENT DOCUMENTS

| | | | | |
|---|---|---|---|---|
| 7,054,570 | B2 | 5/2006 | Kishi et al. | |
| 7,099,616 | B2 * | 8/2006 | Kato et al. | 399/328 |
| 7,116,923 | B2 | 10/2006 | Kishi et al. | |
| 7,130,555 | B2 | 10/2006 | Kishi et al. | |
| 7,209,675 | B2 | 4/2007 | Matsusaka et al. | |
| 7,212,758 | B2 | 5/2007 | Kishi et al. | |
| 7,212,759 | B2 | 5/2007 | Kishi et al. | |
| 7,239,821 | B2 | 7/2007 | Matsusaka et al. | |
| 7,308,216 | B2 | 12/2007 | Kishi et al. | |
| 7,333,743 | B2 | 2/2008 | Kishi et al. | |
| 7,343,113 | B2 | 3/2008 | Matsusaka et al. | |
| 7,356,270 | B2 | 4/2008 | Matsusaka et al. | |
| 7,366,432 | B2 | 4/2008 | Kishi et al. | |
| 7,373,094 | B2 | 5/2008 | Kishi et al. | |
| 7,496,309 | B2 | 2/2009 | Matsusaka et al. | |
| 7,515,845 | B2 | 4/2009 | Kishi et al. | |
| 7,551,869 | B2 | 6/2009 | Kishi et al. | |
| 7,565,087 | B2 | 7/2009 | Matsusaka et al. | |
| 7,603,049 | B2 | 10/2009 | Kishi et al. | |

(Continued)

FOREIGN PATENT DOCUMENTS

| | | |
|---|---|---|
| JP | 2975435 A | 9/1992 |
| JP | 06214467 A | 8/1994 |

(Continued)

OTHER PUBLICATIONS

English language abstract for JP-04-264479 published Sep. 21, 1992 (which corresponds to JP-2975435-A).

*Primary Examiner* — Susan Lee
(74) *Attorney, Agent, or Firm* — Harness, Dickey & Pierce, P.L.C.

(57) ABSTRACT

A heating device for heating a rotary heated member includes a heater and a temperature detector. The heater faces the rotary heated member to heat the rotary heated member. The temperature detector faces the rotary heated member via the heater to detect a temperature of the rotary heated member. The heater includes a housing provided between the temperature detector and the rotary heated member, a through-hole provided in the housing via which the temperature detector faces the rotary heated member, and a channel provided in the housing at a position downstream from the through-hole in a direction of rotation of the rotary heated member through which an air current generated in a gap between the heater and the rotary heated member moves. The channel has a hollow cross-sectional area greater than a hollow cross-sectional area of the through-hole.

9 Claims, 9 Drawing Sheets

U.S. PATENT DOCUMENTS

| | | | | |
|---|---|---|---|---|
| 7,609,988 | B2 | 10/2009 | Kishi et al. | |
| 7,664,410 | B2 | 2/2010 | Takagi | |
| 7,725,065 | B2 * | 5/2010 | Baba et al. | 399/328 |
| 7,773,931 | B2 * | 8/2010 | Jung et al. | |
| 7,801,457 | B2 * | 9/2010 | Seo et al. | 399/69 |
| 8,290,387 | B2 * | 10/2012 | Hara | 399/69 |
| 2004/0245241 | A1 | 12/2004 | Kishi et al. | |
| 2004/0247332 | A1 | 12/2004 | Kishi et al. | |
| 2004/0247334 | A1 | 12/2004 | Kishi et al. | |
| 2004/0258426 | A1 | 12/2004 | Kishi et al. | |
| 2005/0123315 | A1 | 6/2005 | Kishi et al. | |
| 2005/0139584 | A1 | 6/2005 | Kishi et al. | |
| 2005/0175368 | A1 | 8/2005 | Matsusaka et al. | |
| 2005/0175370 | A1 | 8/2005 | Matsusaka et al. | |
| 2005/0191078 | A1 | 9/2005 | Kishi et al. | |
| 2006/0039713 | A1 | 2/2006 | Kishi et al. | |
| 2006/0051111 | A1 | 3/2006 | Kishi et al. | |
| 2006/0051112 | A1 | 3/2006 | Matsusaka et al. | |
| 2006/0051113 | A1 | 3/2006 | Kishi et al. | |
| 2006/0051119 | A1 | 3/2006 | Kishi et al. | |
| 2006/0051120 | A1 | 3/2006 | Kishi et al. | |
| 2006/0051121 | A1 | 3/2006 | Matsusaka et al. | |
| 2006/0127118 | A1 | 6/2006 | Kishi et al. | |
| 2006/0182460 | A1 | 8/2006 | Kishi et al. | |
| 2007/0014600 | A1 | 1/2007 | Ishii et al. | |
| 2007/0031159 | A1 | 2/2007 | Kishi et al. | |
| 2007/0212090 | A1 | 9/2007 | Matsusaka et al. | |
| 2008/0145088 | A1 | 6/2008 | Matsusaka et al. | |
| 2009/0060550 | A1 * | 3/2009 | Seo | 399/69 |
| 2009/0123172 | A1 | 5/2009 | Kishi et al. | |
| 2009/0317113 | A1 | 12/2009 | Kishi et al. | |
| 2010/0215390 | A1 * | 8/2010 | Tomita et al. | 399/69 |
| 2011/0076070 | A1 * | 3/2011 | Koshida | 399/328 |

FOREIGN PATENT DOCUMENTS

| | | | |
|---|---|---|---|
| JP | 2001013805 | A | 1/2001 |
| JP | 2003316182 | A | 11/2003 |
| JP | 2004012804 | A | 1/2004 |
| JP | 2004279538 | A | 10/2004 |
| JP | 2006317530 | A | 11/2006 |
| JP | 2009271129 | A | 11/2009 |
| JP | 2009288396 | A | 12/2009 |

* cited by examiner

HEATING DEVICE, FIXING DEVICE, AND IMAGE FORMING APPARATUS

PRIORITY STATEMENT

The present patent application claims priority from Japanese Patent Application No. 2009-245040, filed on Oct. 26, 2009 in the Japan Patent Office, which is hereby incorporated herein by reference in its entirety.

BACKGROUND OF THE INVENTION

1. Field of the Invention

Example embodiments generally relate to a heating device, a fixing device, and an image forming apparatus, and more particularly, to a heating device for heating a fixing member that applies heat to a toner image on a recording medium, a fixing device including the heating device, and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing roller that generates heat by electromagnetic induction heating and a pressing roller pressed against the fixing roller to form a fixing nip between the fixing roller and the pressing roller. As a recording medium bearing a toner image passes through the fixing nip between the fixing roller and the pressing roller, the fixing roller and the pressing roller apply heat and pressure to the recording medium to melt and fix the toner image on the recording medium. Thereafter, the recording medium bearing the fixed toner image is discharged from the fixing nip.

The heat applied by the fixing roller to the recording medium may be caused by a coil facing the fixing roller by induction heating. Specifically, when an electric current is applied to the coil facing the fixing roller, the coil generates a magnetic field that causes the fixing roller to generate an eddy current. The eddy current causes the fixing roller to generate heat. Such heat generation of the fixing roller may be controlled by a temperature sensor that detects the temperature of the fixing roller so as to maintain the proper temperature of the fixing roller for fixing. For example, a contact sensor (e.g., a thermistor) can be disposed in contact with the outer circumferential surface of the fixing roller to detect the temperature of the outer circumferential surface of the fixing roller. Alternatively, a non-contact sensor (e.g., a thermopile), which is separated from the fixing roller and receives infrared rays radiated from the outer circumferential surface of the fixing roller, detects the temperature of the outer circumferential surface of the fixing roller based on the received infrared rays.

However, the non-contact sensor has a drawback in that steam generated in a gap between the coil and the fixing roller or wax volatilized from toner on the fixing roller, which is transferred from the toner image on the recording medium, may adhere to the non-contact sensor, thereby degrading the sensor's sensitivity. For example, the non-contact sensor faces the fixing roller via a through-hole provided in the coil to detect the temperature of the fixing roller via the through-hole of the coil. The steam generated in the gap between the coil and the fixing roller and the wax volatilized from toner on the fixing roller may move through the through-hole of the coil and adhere to the non-contact sensor facing the through-hole. Accordingly, the steam and the wax adhered to the non-contact sensor may cause erroneous detection of the non-contact sensor, resulting in formation of a faulty toner image or malfunction and burning of the fixing device due to unstable control of the temperature of the fixing roller.

SUMMARY

At least one embodiment may provide a heating device that heats a rotary heated member rotating in a predetermined direction of rotation. The heating device includes a heater and a temperature detector. The heater faces the rotary heated member without contacting the rotary heated member to heat the rotary heated member. The temperature detector faces the rotary heated member via the heater to detect a temperature of the rotary heated member. The heater includes a housing, a through-hole, and a channel. The housing is provided between the temperature detector and the rotary heated member. The through-hole is provided in the housing, and the temperature detector faces the rotary heated member via the through-hole. The channel is provided in the housing at a position downstream from the through-hole in the direction of rotation of the rotary heated member, and an air current generated in a gap between the heater and the rotary heated member moves through the channel. The channel has a hollow cross-sectional area greater than a hollow cross-sectional area of the through-hole.

At least one embodiment may provide a fixing device that fixes a toner image on a recording medium, and includes a pressing portion and a heating portion. The pressing portion contacts the recording medium bearing the toner image to apply heat and pressure to the recording medium bearing the toner image, and includes a rotary heated member rotating in a predetermined direction of rotation. The heating portion faces the pressing portion to heat the rotary heated member of the pressing portion, and includes the heating device described above.

At least one embodiment may provide an image forming apparatus that includes an image carrier that carries an electrostatic latent image, a development device that faces the image carrier to make the electrostatic latent image carried on the image carrier visible as a toner image, a transfer device that faces the image carrier to transfer the toner image formed on the image carrier onto a recording medium, and the above-described fixing device provided downstream from the transfer device in a recording medium conveyance direction to fix the toner image on the recording medium.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
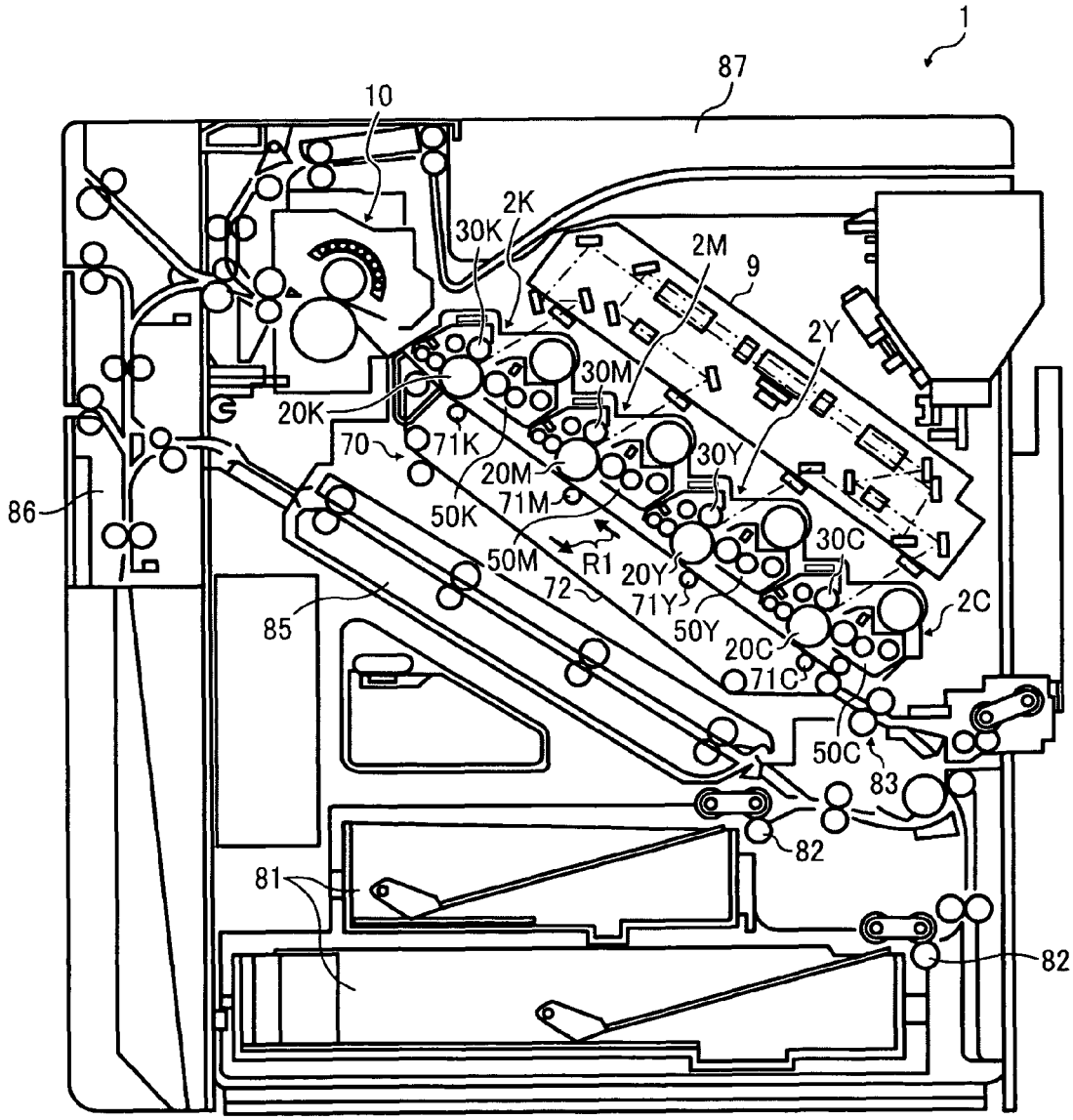
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 may be a copier, a facsimile machine, a printer, a multifunction printer having at least one of copying, printing, scanning, plotter, and facsimile functions, or the like. The image forming apparatus 1 may form a color image and/or a monochrome image by electrophotography. According to this example embodiment, the image forming apparatus 1 is a printer for forming a color image on a recording medium by electrophotography.

As illustrated in FIG. 1, the image forming apparatus 1 includes process cartridges 2K, 2M, 2Y, and 2C, an exposure device 9, a fixing device 10, a transfer device 70, paper trays 81, separators 82, a registration roller pair 83, a duplex unit 85, a reverse unit 86, and an output tray 87.

The process cartridges 2K, 2M, 2Y, and 2C include photoconductors 20K, 20M, 20Y, and 20C, chargers 30K, 30M, 30Y, and 30C, and development devices 50K, 50M, 50Y, and 50C, respectively. The transfer device 70 includes transfer rollers 71K, 71M, 71Y, and 71C and a transfer belt 72.

The process cartridges 2K, 2M, 2Y, and 2C, serving as four image carrier units, are detachably attached to the image forming apparatus 1.

The transfer device 70 is provided in substantially a center portion of the image forming apparatus 1, and includes the transfer belt 72 that is looped over a plurality of rollers and is rotatable in a rotation direction R1. The four transfer rollers 71K, 71M, 71Y, and 71C are provided inside a loop formed by the transfer belt 72 in such a manner that the four transfer rollers 71K, 71M, 71Y, and 71C are disposed opposite the four photoconductors 20K, 20M, 20Y, and 20C, respectively. The photoconductors 20K, 20M, 20Y, and 20C, serving as image carriers, contact an upper outer circumferential surface of the transfer belt 72.

The process cartridges 2K, 2M, 2Y, and 2C include the development devices 50K, 50M, 50Y, and 50C that contain toner of different colors, respectively. The development devices 50K, 50M, 50Y, and 50C have an identical structure but contain and use two-component developer containing carrier particles and toner particles of different colors, respectively. For example, the development devices 50K, 50M, 50Y, and 50C use black, magenta, yellow, and cyan toners, respectively.

Each of the development devices 50K, 50M, 50Y, and 50C includes a development roller, a screw, and a toner density sensor. The development roller is disposed opposite each of the photoconductors 20K, 20M, 20Y, and 20C, and includes a rotatable sleeve and a magnet fixedly provided inside the sleeve. The screw conveys and agitates the developer. A toner supplier supplies toner to each of the development devices 50K, 50M, 50Y, and 50C based on a density of toner detected by the toner density sensor.

The toner contains a binder resin, a colorant, and an electric potential adjuster as main ingredients. Other additives may be added to the toner as needed. For example, the binder resin may include polystyrene, styrene-acrylic ester copolymer, polyester, and/or the like. Known colorants may be used for the yellow, magenta, cyan, and black toners. The colorant in an amount in a range of from about 0.1 parts by weight to about 15.0 parts by weight may correspond to the binder resin in an amount of about 100 parts by weight.

The electric potential adjuster may include nigrosine dye, chrome complex, quaternary ammonium salt, and/or the like, which may be selectively used according to a polarity of toner particles. The electric potential adjuster in an amount in a range of from about 0.1 parts by weight to about 10.0 parts by weight may correspond to the binder resin in an amount of about 100 parts by weight.

A fluidizing agent may be added to toner particles. The fluidizing agent may include metal oxide fine particles such as silica, titania, and alumina, metal oxide fine particles surface-treated with a silane coupling agent or a titanate coupling agent, polymer fine particles such as polystyrene, polymethyl methacrylate, and polyvinylidene fluoride, and/or the like. The fluidizing agent may have a particle size in a range of from about 0.01 μm to about 3.00 μm. The fluidizing agent in an amount in a range of from about 0.1 parts by weight to about 7.0 parts by weight may correspond to the toner particles in an amount of about 100 parts by weight.

Toner particles contained in the two-component developer may be manufactured by various known methods or combination of known methods. For example, in a kneading-pulverizing method, a binder resin, a colorant such as carbon black, and a necessary additive are dry-blended, heated, molten, and kneaded by an extruder, two rolls, or three rolls. After being cooled and solidified, the components are crushed by a grinder such as a jet mill and sized by an air current classifier. Alternatively, a monomer, a colorant, and an additive may be manufactured into toner particles directly by a suspension polymerization method or a non-aqueous dispersion polymerization method.

Generally, a carrier particle includes a core only or a core and a coating layer provided on the core. The core of the resin-coating carrier used in the image forming apparatus 1 includes a magnetic material such as ferrite and magnetite, which has a particle size in a range of from about 20 μm to about 60 μm.

The coating layer includes vinylidene fluoride, tetrafluoroethylene, hexafluoropropylene, perfluoroalkylvinylether, vinylether prepared by substitution of fluorine atom, vinylketone prepared by substitution of fluorine atom, and/or the like. The coating layer is prepared by known methods, for example, by applying resin to a surface of the core of the carrier particle by using a spraying method, a dipping method, or the like.

The exposure device 9 is provided above the process cartridges 2K, 2M, 2Y, and 2C, and emits laser beams onto the photoconductors 20K, 20M, 20Y, and 20C. The reverse unit 86 is provided in a left portion of the image forming apparatus 1 in FIG. 1, and reverses a recording sheet serving as a recording medium bearing a toner image to output the recording sheet to an outside of the image forming apparatus 1 or to send the recording sheet to the duplex unit 85. The duplex unit 85 is provided below the transfer belt 72, and receives and contains the reversed recording sheet sent from the reverse unit 86. The exposure device 9 includes four light sources (e.g., laser diodes) corresponding to black, magenta, yellow, and cyan colors, respectively, a polygon scanner including a hexahedral polygon mirror and a polygon motor, an fθ lens provided on an optical path of each light source, a lens such as long, wide toroidal lens (WTL), and mirrors. Laser beams emitted by the laser diodes are deflected by the polygon scanner, and scan and irradiate the photoconductors 20K, 20M, 20Y, and 20C, respectively.

The duplex unit 85 includes a conveyance guide plate pair and a plurality of conveyance roller pairs. In a duplex print mode for forming a toner image on front and back sides of a recording sheet, the recording sheet bearing the toner image on the front side thereof is conveyed to a reverse conveyance path of the reverse unit 86, and switched back toward the duplex unit 85. The duplex unit 85 receives the recording sheet and sends the recording sheet toward the process cartridges 2C, 2Y, 2M, and 2K.

The reverse unit 86 includes a plurality of conveyance roller pairs and a plurality of conveyance guide plate pairs. As described above, the reverse unit 86 reverses the recording sheet bearing the toner image on the front side thereof and sends the reversed recording sheet to the duplex unit 85 for duplex printing. Alternatively, the reverse unit 86 discharges the recording sheet bearing the toner image to the outside of the image forming apparatus 1 without reversing the recording sheet or after reversing the recording sheet.

Each of the paper trays 81 loads a plurality of recording sheets. Each of the separators 82 separates an uppermost recording sheet from other recording sheets loaded on the paper tray 81 and feeds the uppermost recording sheet toward the process cartridges 2C, 2Y, 2M, and 2K.

The fixing device 10 is provided between the transfer belt 72 and the reverse unit 86, and fixes the toner image on the recording sheet. A reverse output path is provided downstream from the fixing device 10 in a recording sheet conveyance direction, and is bifurcated into a reverse path connected to the reverse unit 86 and an output path connected to an output roller pair that discharges the recording sheet to the output tray 87.

The transfer belt 72 includes a resin material, such as polyvinylidene fluoride, polyimide, polycarbonate, polyethylene terephthalate, and/or the like, and is molded into a seamless, endless belt. Such resin material may be electrical resistance-adjusted with a conductive material such as carbon black or may be used without resistance adjustment. Further, the transfer belt 72 may have a multi-layer structure including a base layer formed of the above resin material and a surface layer formed on the base layer by spraying or dipping.

The two-staged paper trays 81 are provided in a lower portion of the image forming apparatus 1, and contain recording sheets of different sizes, respectively. Further, an openable bypass tray is provided in a right portion of the image forming apparatus 1 in FIG. 1. A user can open the bypass tray and place a recording sheet (e.g., thick paper or a postcard) on the bypass tray.

Referring to FIG. 1, the following describes operation of the image forming apparatus 1 for forming a color toner image.

When the image forming apparatus 1 receives color image data from an external device, for example, the photoconductors 20K, 20M, 20Y, and 20C rotate clockwise in FIG. 1. Charging rollers of the chargers 30K, 30M, 30Y, and 30C uniformly charge surfaces of the photoconductors 20K, 20M, 20Y, and 20C, respectively. The exposure device 9 emits a laser beam corresponding to cyan image data onto the charged surface of the photoconductor 20C to form an electrostatic latent image corresponding to cyan image data. The exposure device 9 emits a laser beam corresponding to yellow image data onto the charged surface of the photoconductor 20Y to form an electrostatic latent image corresponding to yellow image data. The exposure device 9 emits a laser beam corresponding to magenta image data onto the charged surface of the photoconductor 20M to form an electrostatic latent image corresponding to magenta image data. The exposure device 9 emits a laser beam corresponding to black image data onto the charged surface of the photoconductor 20K to form an electrostatic latent image corresponding to black image data. When the electrostatic latent images corresponding to the cyan, yellow, magenta, and black image data reach positions facing the development devices 50C, 50Y, 50M, and 50K, respectively, by rotation of the photoconductors 20C, 20Y, 20M, and 20K, the development devices 50C, 50Y, 50M, and 50K supply cyan, yellow, magenta, and black toners to the electrostatic latent images formed on the photoconductors 20C, 20Y, 20M, and 20K, respectively, to make the electrostatic latent images visible as cyan, yellow, magenta, and black toner images.

The separator 82 separates an uppermost recording sheet from other recording sheets loaded on the paper tray 81, and feeds the uppermost recording sheet to the registration roller pair 83 provided upstream from the transfer belt 72 in the recording sheet conveyance direction. The registration roller pair 83 feeds the recording sheet to the transfer belt 72 at a proper time at which the cyan, yellow, magenta, and black toner images formed on the photoconductors 20C, 20Y, 20M, and 20K face the recording sheet conveyed by the transfer belt 72. A transfer roller provided near an entry to the transfer belt 72 charges the recording sheet with a positive polarity so that the recording sheet is electrostatically attracted to an outer circumferential surface of the transfer belt 72. As the recording sheet attracted to the transfer belt 72 is conveyed by the transfer belt 72, the transfer rollers 71C, 71Y, 71M, and 71K transfer the cyan, yellow, magenta, and black toner images from the photoconductors 20C, 20Y, 20M, and 20K onto the recording sheet conveyed by the transfer belt 72 successively. Thus, the cyan, yellow, magenta, and black toner images are superimposed on a same position on the recording sheet to form a color toner image on the recording sheet.

The fixing device 10 applies heat and pressure to the recording sheet bearing the color toner image to melt and fix the color toner image on the recording sheet.

Thereafter, the recording sheet bearing the fixed color toner image passes through a path corresponding to a mode specified by a user. For example, the recording sheet passes through the output path connected to the output roller pair, and is reversed and discharged onto the output tray 87 provided in an upper portion of the image forming apparatus 1. Alternatively, the recording sheet passes through the reverse path connected to the reverse unit 86, and is discharged straight. Yet alternatively, when the duplex print mode is selected by the user, the recording sheet bearing the color toner image on the front side thereof is conveyed to the reverse conveyance path of the reverse unit 86, and switched back toward the duplex unit 85. The duplex unit 85 receives the recording sheet and sends the recording sheet toward the process cartridges 2C, 2Y, 2M, and 2K. The process cartridges 2C, 2Y, 2M, and 2K form a color toner image on the back side of the recording sheet. Thereafter, the recording sheet bearing the color toner image on both the front and back sides thereof passes through the fixing device 10, and is reversed and discharged onto the output tray 87 or is discharged straight via the reverse unit 86.

When the image forming apparatus 1 receives a print request to form a color toner image on successive recording sheets, the above-described operation is repeated.

The following describes operation of the image forming apparatus 1 for forming a monochrome toner image.

When the image forming apparatus 1 receives monochrome image data from an external device, for example, driving rollers supporting the transfer belt 72 move downward to separate the transfer belt 72 from the photoconductors 20C, 20Y, and 20M used for forming cyan, yellow, and magenta toner images, respectively. As the photoconductor 20K used for forming a black toner image rotates clockwise in FIG. 1, the charging roller of the charger 30K uniformly charges the surface of the photoconductor 20K. The exposure device 9 emits a laser beam corresponding to the monochrome image data onto the charged surface of the photoconductor 20K to form an electrostatic latent image on the photoconductor 20K. When the electrostatic latent image reaches the position facing the development device 50K, the development device 50K supplies black toner to the electrostatic latent image to make the electrostatic latent image visible as a black toner image. By contrast, the process cartridges 2C, 2Y, and 2M are stopped to avoid needless wear.

Figure 2:
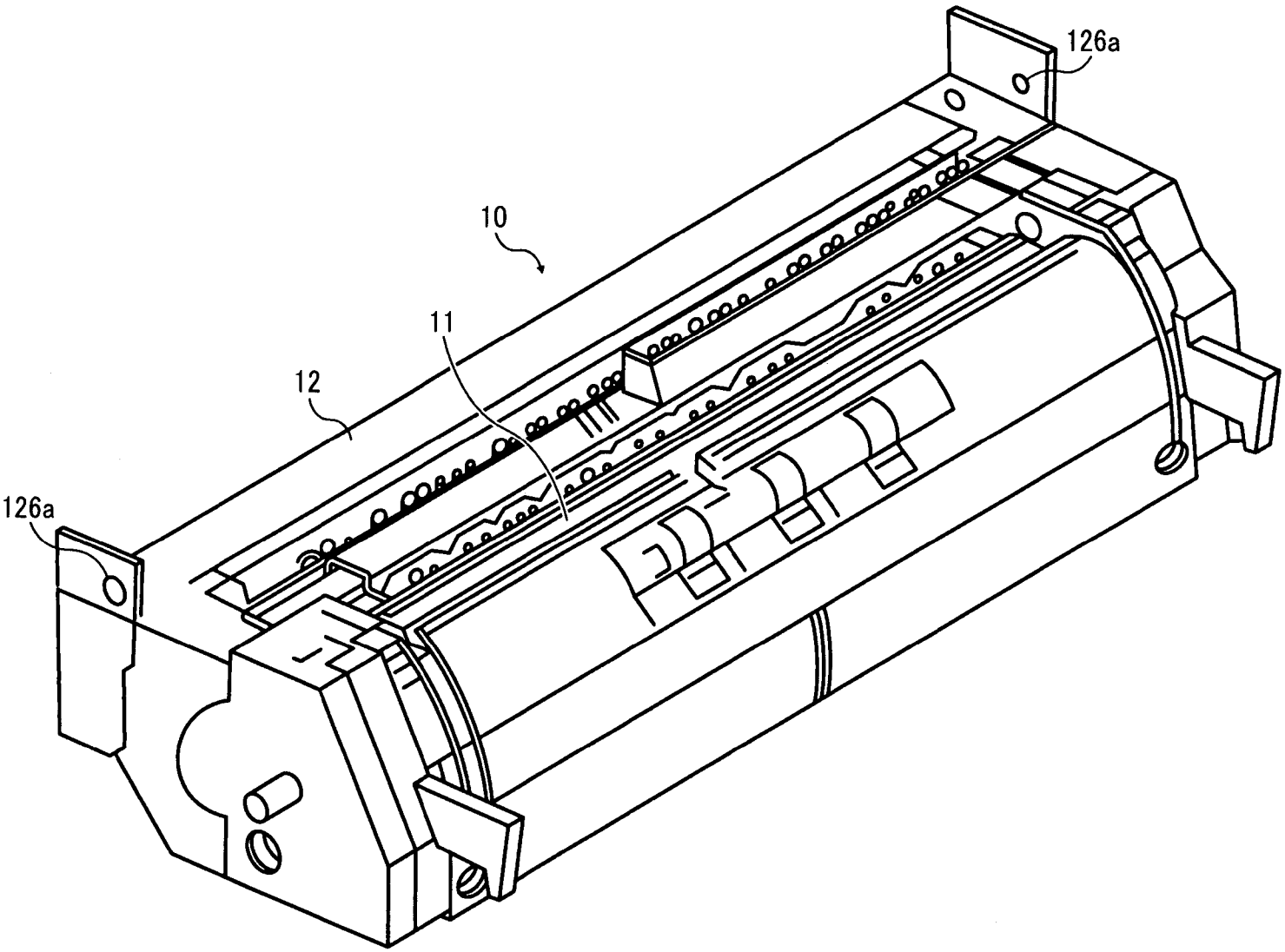
FIG. 2 is a perspective view (according to an example embodiment) of a fixing device included in the image forming apparatus shown in FIG. 1.

FIG. 2 is a perspective view of the fixing device 10. As illustrated in FIG. 2, the fixing device 10 includes a pressing portion 11 and a heating portion 12. The heating portion 12 includes through-holes 126*a*.

The heating portion 12 serves as a heating device that causes the pressing portion 11 to generate heat. The pressing portion 11 then applies heat and pressure to a recording sheet passing through the fixing device 10. The through-holes 126*a* are provided in the heating portion 12, and support the heating portion 12 by engaging pins engaged with through-holes provided in the image forming apparatus 1 depicted in FIG. 1.

Figure 3:
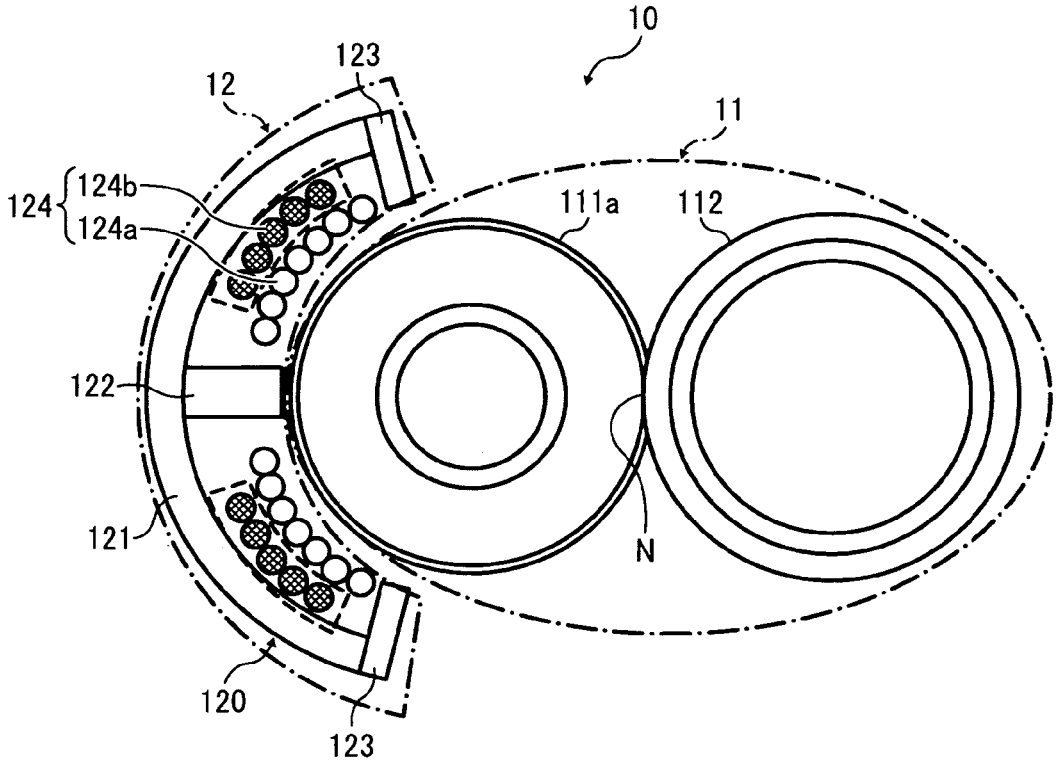
FIG. 3 is a sectional view (according to an example embodiment) of the fixing device shown in FIG. 2.

FIG. 3 is a vertical sectional view of the fixing device 10. As illustrated in FIG. 3, the pressing portion 11 includes a fixing roller 111*a* and a pressing roller 112. The heating portion 12 further includes an induction heater 120. The induction heater 120 includes an arc core 121, a center core 122, side cores 123, and a coil loop 124. The coil loop 124 includes an exciting coil 124*a* and a degaussing coil 124*b*.

The pressing portion 11 is provided separately from the heating portion 12. The heating portion 12 does not include consumable components, and therefore is used permanently unless it otherwise breaks down. By contrast, the fixing roller 111*a*, serving as a rotary heated member of the pressing portion 11 includes a resin film (e.g., a fluorocarbon resin film or a silicon resin film) covering an outer circumferential surface of the fixing roller 111*a*. When the outer circumferential surface of the fixing roller 111*a* is damaged or scratched, toner from the toner image on the recording sheet adheres to the fixing roller 111*a* with a substantial adhering force, generating toner offset easily. Further, the fixing roller 111*a* needs to be replaced when the resin film of the fixing roller 111*a* becomes thinner due to wear. For these reasons, the pressing portion 11 is separately provided from the heating portion 12 so that only the pressing portion 11 is replaced with new one. Thus, the pressing portion 11 and the heating portion 12 are combined into the fixing device 10.

The pressing roller 112 presses against the fixing roller 111*a* to form a fixing nip N between the pressing roller 112 and the fixing roller 111*a*.

For example, the fixing roller 111*a* may have a diameter of about 40 mm, and may include a metal core serving as an innermost layer; a heat insulation layer provided on the metal core and including air (e.g., sponge); a base layer provided on the heat insulation layer; an antioxidant layer provided on the base layer; a heat generation layer provided on the antioxidant layer; an antioxidant layer provided on the heat generation layer; an elastic layer provided on the antioxidant layer; and a release layer provided on the elastic layer and serving as an outer surface layer. The metal core includes iron, an alloy of iron such as SUS stainless steel, and/or the like. The heat insulation layer formed of air provides a gap of about 9 mm. The base layer has a thickness of about 50 μm and includes SUS stainless steel. The antioxidant layer has a thickness not greater than about 1 μm and is nickel strike plated. The heat generation layer has a thickness of about 15 μm and is copper plated. The elastic layer has a thickness of about 150 μm and includes silicon rubber. The release layer has a thickness of about 30 μm and includes perfluoroalkoxy (PFA). The above describes an example of the structure of the fixing roller 111*a*. Alternatively, the fixing roller 111*a* may have other structures.

With the above-described structure, the fixing roller 111*a* provides a smaller heat capacity. Accordingly, the fixing roller 111*a* is heated quickly, providing a shortened warm-up time.

Figure 4:
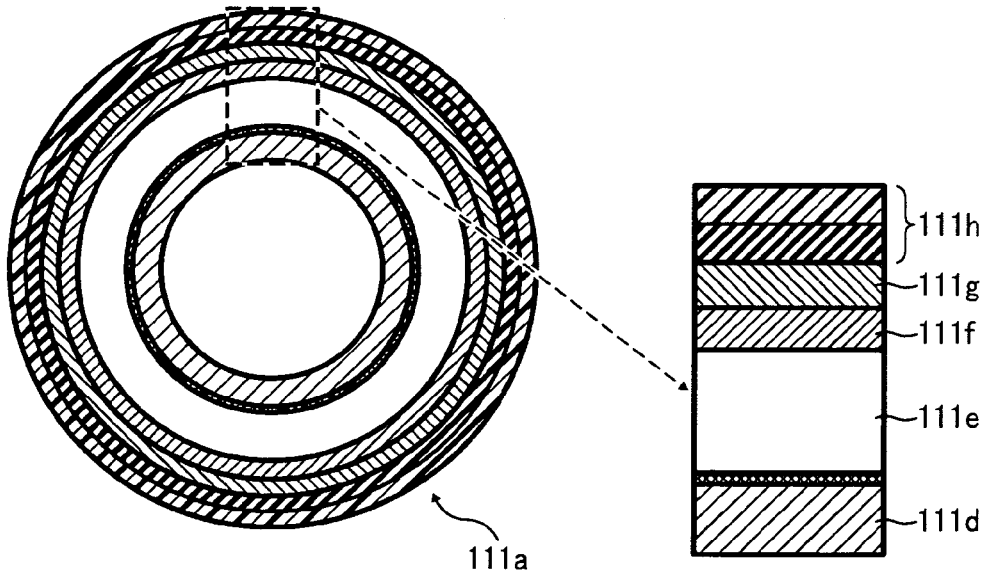
FIG. 4 is a sectional view (according to an example embodiment) of a fixing roller included in the fixing device shown in FIG. 3.

FIG. 4 is a sectional view in elevation of the fixing roller 111*a*. As illustrated in FIG. 4, the fixing roller 111*a* includes a metal core 111*d* serving as an innermost layer; a heat insulation elastic layer 111*e* provided on the metal core 111*d*; a magnetic layer 111*f* provided on the heat insulation elastic layer 111*e*; a heat generation layer 111*g* provided on the magnetic layer 111*f*; and a surface layer 111*h* provided on the heat generation layer 111*g* and serving as an outer surface layer.

The surface layer 111*h* includes two layers, that is, an elastic layer including silicon rubber and a release layer including fluorocarbon resin (e.g., PFA). The release layer of the surface layer 111*h* protects the outer surface of the fixing roller 111*a* and decreases an adhering force that adheres toner to the outer surface of the fixing roller 111*a*. The heat generation layer 111*g* and the magnetic layer 111*f* are integrated by plating, evaporating, or cladding. Alternatively, an induction heat generation layer, that generates heat by magnetic fluxes, may be provided. The metal core 111*d* includes aluminum or an alloy of aluminum, for example.

The pressing roller 112 includes a cylindrical metal core and an elastic layer provided on the metal core. The metal core includes a high conductive metal such as copper or aluminum. Alternatively, the metal core may include SUS stainless steel. The elastic layer provides a high heat resistance and a high release property that separates toner from the pressing roller 112.

According to this example embodiment, a hardness of the pressing roller 112 is greater than a hardness of the fixing roller 111*a*. Accordingly, the pressing roller 112 presses the fixing roller 111*a* in such a manner that a portion of the fixing roller 111*a* facing the pressing roller 112 at the fixing nip N assumes a concave shape. Consequently, the recording sheet passing between the pressing roller 112 and the fixing roller 111*a* moves along a circumference of the pressing roller 112, and therefore the recording sheet separates from an outer circumferential surface of the pressing roller 112 easily. The pressing roller 112 has a diameter of about 40 mm which is equivalent to the diameter of the fixing roller 111*a*. However, the pressing roller 112 has a thickness in a range of from about 0.3 mm to about 20.0 mm, which is smaller than the thickness of the fixing roller 111*a*, and a hardness in a range of from about 10 degrees to about 70 degrees according to Japan Industrial Standards (JIS) K 6301 hardness, which is harder than the hardness of the fixing roller 111*a*.

An application roller applies oil (e.g., silicon oil) to the fixing roller 111*a* to facilitate separation of toner from the fixing roller 111*a* so as to prevent toner offset. A cleaning roller, serving as a cleaner, removes toner and paper dust adhered from the recording sheet to the fixing roller 111*a*.

Similarly, another cleaning roller is provided for the pressing roller 112 to remove paper dust adhered from the recording sheet and toner adhered from the fixing roller 111*a* to the pressing roller 112 when the recording sheet does not pass between the fixing roller 111*a* and the pressing roller 112.

Figure 5A:
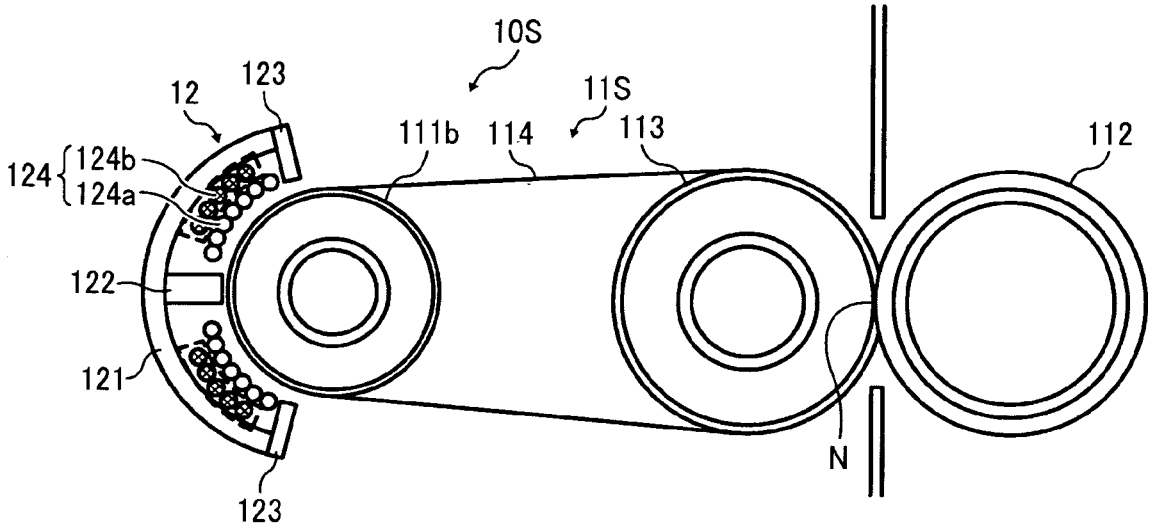
FIG. 5A is a sectional view of a fixing device according to another example embodiment.

FIG. 5A is a sectional view of a fixing device 10S according to another example embodiment. As illustrated in FIG. 5A, the fixing device 10S includes a pressing portion 11S and the heating portion 12. The pressing portion 11S includes a heating roller 111*b*, the pressing roller 112, a support roller 113, and a fixing belt 114.

The heating roller 111*b* serves as a rotary heated member. The fixing belt 114 is stretched over the heating roller 111*b* and the support roller 113, and rotates. The heating portion 12 including the exciting coil 124*a* surrounds the heating roller 111*b* substantially, and causes the heating roller 111*b* to generate heat. The heating roller 111*b* heats the fixing belt 114 wound around the heating roller 111*b* and rotating with the heating roller 111*b*. As a recording sheet bearing a toner image passes through a fixing nip N formed between the pressing roller 112 and the support roller 113 over the fixing belt 114, the recording sheet receives pressure from the pressing roller 112 and heat from the fixing belt 114 heated by the heating roller 111*b*. Thus, the toner image is fixed on the recording sheet by the pressure and the heat applied by the pressing roller 112 and the fixing belt 114.

Figure 5B:
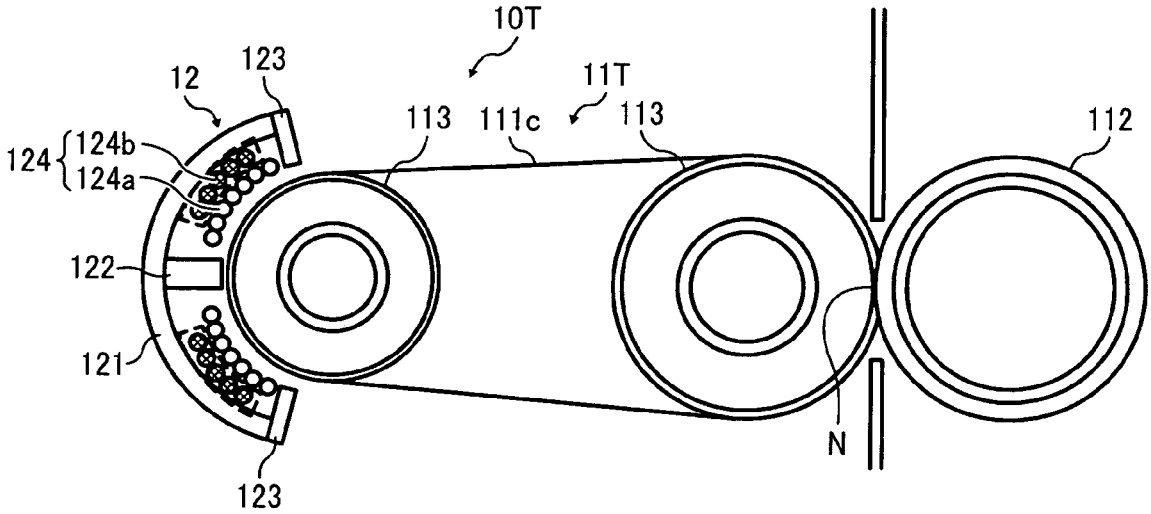
FIG. 5B is a sectional view of a fixing device according to yet another example embodiment.

FIG. 5B is a sectional view of a fixing device 10T according to yet another example embodiment. As illustrated in FIG. 5B, the fixing device 10T includes a pressing portion 11T and the heating portion 12. The pressing portion 11T includes a fixing belt 111*c*, the pressing roller 112, and support rollers 113.

The fixing belt 111*c* serves as a rotary heated member. The fixing belt 111*c* is stretched over the support rollers 113, and rotates. The heating portion 12 including the exciting coil 124*a* surrounds one of the support rollers 113 substantially, and causes the fixing belt 111*c*, which is wound around the support roller 113 and rotates with the support roller 113, to generate heat. As a recording sheet bearing a toner image passes through a fixing nip N formed between the pressing roller 112 and the support roller 113 over the fixing belt 111*c*, the recording sheet receives pressure from the pressing roller 112 and heat from the fixing belt 111*c* heated by the heating portion 12. Thus, the toner image is fixed on the recording sheet by the pressure and the heat applied by the pressing roller 112 and the fixing belt 111*c*.

As illustrated in FIG. 3, the heating portion 12 includes the induction heater 120, serving as a heater, which causes the fixing roller 111*a* to generate heat by electromagnetic induction. The coil loop 124 serves as a heating member or a magnetic field generator, and includes the exciting coil 124*a* and the degaussing coil 124*b*. The exiting coil 124*a* is wound along the arc core 121. The arc core 121 has a semi-cylindrical shape, and is disposed close to the outer circumferential surface of the fixing roller 111*a*. The exiting coil 124*a* includes a long, single exciting coil wire wound along the arc core 121 in an axial direction of the fixing roller 111*a*.

An oscillator circuit of the exciting coil 124*a* is connected to a frequency-changeable, driving power source. The center core 122 is provided outside the exciting coil 124*a* at a position close to the exciting coil 124*a*, and is fixed to the arc core 121. The center core 122 has a semi-cylindrical shape and includes a ferromagnet such as ferrite. According to this example embodiment, the arc core 121 and the center core 122 have a relative magnetic permeability of about 2,500.

The driving power source supplies a high-frequency alternating current in a range of from about 10 kHz to about 1 MHz, preferably a high-frequency alternating current in a range of from about 20 kHz to about 800 kHz, to the exciting coil 124*a*, so as to generate an alternating magnetic field. In principle, when an electric conductor is provided in the alternating magnetic field, an eddy current flows in the electric conductor by electromagnetic induction. The eddy current generates Joule heat so that the electric conductor generates heat by the Joule heat. Thus, fixing roller 111*a* generates heat.

For example, in the fixing device 10, 10S, or 10T, a part of the rotary heated member (e.g., the fixing roller 111*a*, the heating roller 111*b*, or the fixing belt 111*c*) or the entire portion of the rotary heated member serves as an electric conductor. A magnetic flux generation coil (e.g., the exiting coil 124*a*) is provided inside or outside the rotary heated member. An alternating magnetic field generated when an alternating current flows in the magnetic flux generation coil generates an induction electric current, that is, an eddy current, in the electric conductor of the rotary heated member. The eddy current and a resistance of the electric conductor of the rotary heated member cause the electric conductor to generate Joule heat. Specifically, the alternating magnetic field generated in a contact region in which the heating portion 12 contacts or faces the rotary heated member and a vicinity of the contact region causes the heat generation layer 111*g* of the rotary heated member depicted in FIG. 4 to generate an eddy current flowing in a direction to prevent change of the alternating magnetic field. The eddy current generates Joule heat corresponding to a resistance of the heat generation layer 111*g*, and the Joule heat heats the rotary heated member by electromagnetic induction in the contact region in which the heating portion 12 contacts or faces the rotary heated member and the vicinity of the contact region.

The degaussing coil 124*b* is provided on the exciting coil 124*a* to form the coil loop 124. The exciting coil 124*a* generates an induction magnetic flux. The induction magnetic flux causes the heat generation layer 111*g* of the fixing roller 111*a* to generate an eddy current that causes the fixing roller 111*a* to generate heat. Simultaneously, the degaussing coil 124*b* generates a magnetic flux in a direction opposite to a direction of the induction magnetic flux generated by the exciting coil 124*a* as needed. An induction electric current flows in the degaussing coil 124*b* to cancel the induction magnetic flux generated by the exciting coil 124*a* to suppress the eddy current generated by the heat generation layer 111*g* of the fixing roller 111*a*. Thus, switching between the exciting coil 124*a* and the degaussing coil 124*b* adjusts an amount of heat generation of the fixing roller 111*a*.

Figure 6A:
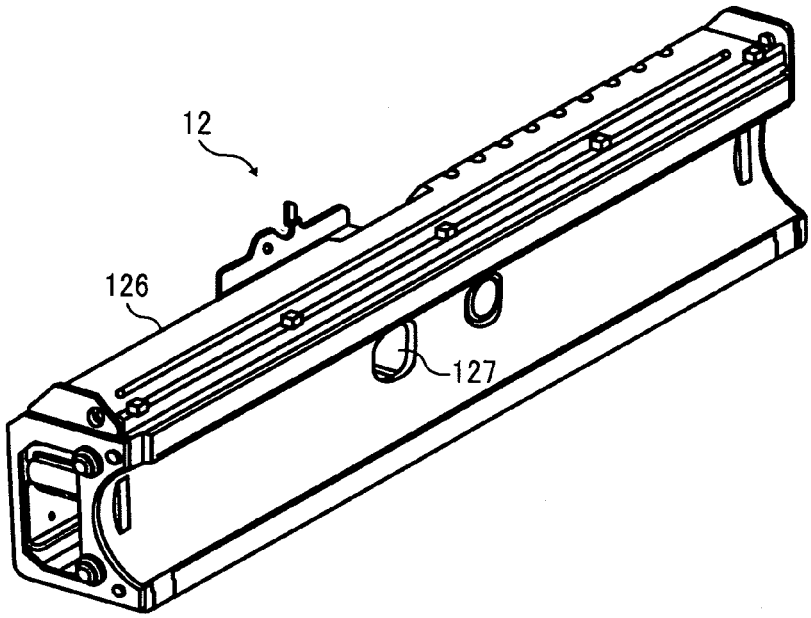
FIG. 6A is a perspective view (according to an example embodiment) of a heating portion included in the fixing device shown in FIG. 3.
Figure 6B:
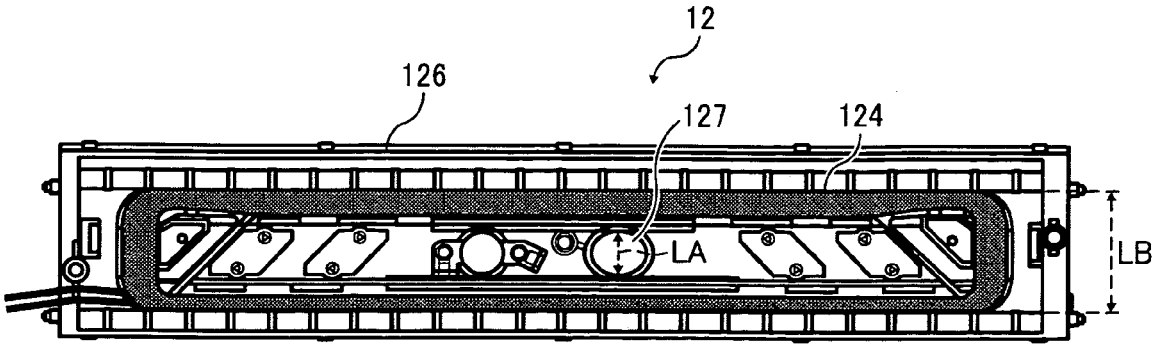
FIG. 6B is a side view (according to an example embodiment) of the heating portion shown in FIG. 6A.

FIG. 6A is a perspective view of the heating portion 12. FIG. 6B is a side view of the heating portion 12. As illustrated in FIGS. 6A and 6B, the heating portion 12 further includes a housing 126 and a through-hole 127.

Figure 7:
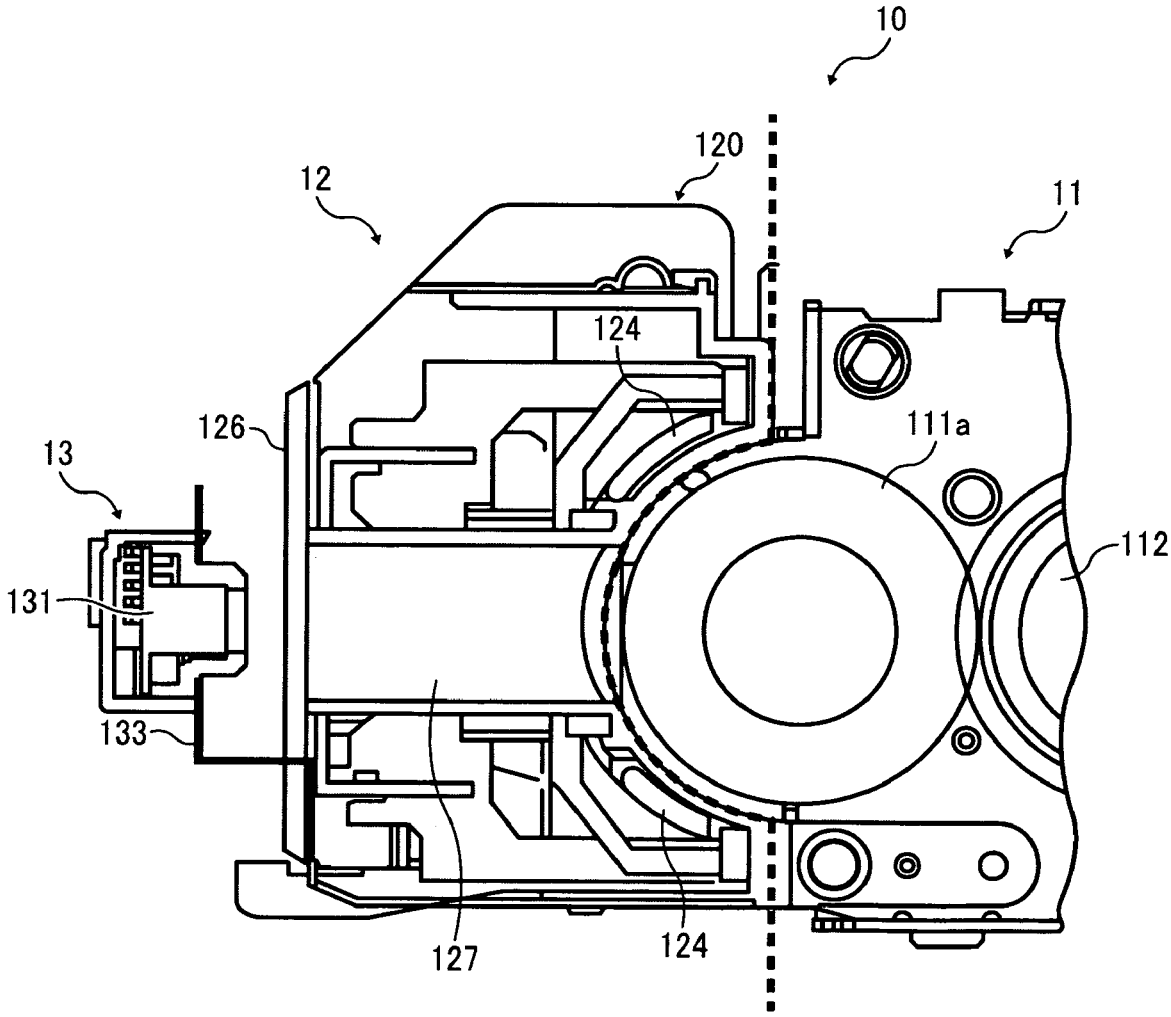
FIG. 7 is a partial sectional view (according to an example embodiment) of the fixing device shown in FIG. 3.

FIG. 7 is a partial sectional view of the fixing device 10. As illustrated in FIG. 7, the heating portion 12 further includes a temperature detector 13. The temperature detector 13 includes a thermopile element 131 and a support member 133.

As illustrated in FIG. 6B, the through-hole 127 is provided inside a loop formed by the coil loop 124 including the exciting coil 124*a* and the degaussing coil 124*b* depicted in FIG. 3. As illustrated in FIG. 7, the temperature detector 13 faces the through-hole 127 and detects a surface temperature of the fixing roller 111*a* via the through-hole 127.

As illustrated in FIG. 6B, the wire of the exciting coil 124*a* and the degaussing coil 124*b* forming the coil loop 124 is fixed to the heating portion 12 in such a manner that both ends of the wire are connected to an inverter. When the inverter applies a high-frequency electric current to the coil loop 124, an induction electric current generates in the heat generation layer 111*g* of the fixing roller 111*a* (depicted in FIG. 4) to heat the fixing roller 111*a*. The temperature detector 13 measures the surface temperature of the fixing roller 111*a* in a temperature detection region corresponding to a position inside the coil loop 124, saving space.

Design parameters including a number of winding of the wire of the coil loop 124, a length of the coil loop 124 with respect to the fixing roller 111*a*, and a shape of the coil loop 124 in a circumferential direction of the fixing roller 111*a* influence temperature distribution of the fixing roller 111*a* in the axial direction of the fixing roller 111*a*.

As illustrated in FIG. 6B, a length LA of the through-hole 127 in the circumferential direction of the fixing roller 111*a* is minimized. By contrast, a length LB of the coil loop 124 is maximized in the circumferential direction of the fixing roller 111*a*. Thus, an area of the coil loop 124 facing the fixing roller 111*a* is maximized to enhance heating efficiency for heating the fixing roller 111*a*.

As illustrated in FIG. 7, the temperature detector 13 includes the non-contact thermopile element 131 that does not contact the fixing roller 111*a*. If a contact thermistor is used, the contact thermistor may damage the fixing roller 111*a*, shortening life of the fixing device 10. Moreover, toner may move from the fixing roller 111*a* to the contact thermistor, and may be accumulated on the contact thermistor. The accumulated toner may further move to the fixing roller 111*a*, deteriorating a toner image on a recording sheet passing between the fixing roller 111*a* and the pressing roller 112 and forming a faulty toner image.

The non-contact thermopile element 131 is an infrared sensor that receives infrared rays radiated from each object and generates a thermoelectromotive force according to an amount of energy of the infrared rays to detect an absolute amount of energy (e.g., temperature) of the object. On the other hand, a pyroelectric infrared sensor detects temperature change to provide a differential output. By contrast, the thermopile element 131 uses a thermoelectromotive force effect to detect the absolute temperature. Thus, the thermopile element 131, which detects the temperature without contacting the fixing roller 111*a*, is preferably used as a temperature detector for detecting the temperature of the fixing roller 111*a*.

The support member 133 is mounted on the heating portion 12 (e.g., the housing 126), and supports the temperature detector 13. A broken line in FIG. 7 divides the fixing device 10 into the pressing portion 11 and the heating portion 12. The pressing portion 11 provided on the right of the broken line in FIG. 7 is detachably attached to the image forming apparatus 1 depicted in FIG. 1. The heating portion 12 provided on the left of the broken line in FIG. 7 is supported by the through-holes 126*a* (depicted in FIG. 2) provided in the heating portion 12 and the pins engaging the through-holes 126*a* and the through-holes provided in the image forming apparatus 1. A biasing member (e.g., a spring) presses the entire heating portion 12 against the pressing portion 11. A positioning member provided in the pressing portion 11 maintains a predetermined distance between the fixing roller 111*a* and the heating portion 12.

The heating portion 12 is rotatable about the through-holes 126*a*. Accordingly, even when production errors shift the pressing portion 11 from its proper position, a predetermined distance is maintained between the heating portion 12 and the fixing roller 111*a* of the pressing portion 11, providing stable heat generation efficiency. However, the through-hole 127 of the heating portion 12 rotates in accordance with rotation of the heating portion 12. Accordingly, if the temperature detector 13 is attached to a portion of the image forming apparatus 1 other than the heating portion 12, the temperature detector 13 is not positioned properly with respect to the through-hole 127 of the heating portion 12. Consequently, the temperature detector 13 may detect a temperature of an interior surface of the through-hole 127, degrading accuracy of detecting the surface temperature of the fixing roller 111*a*.

To address this problem, according to this example embodiment, the support member 133 of the temperature detector 13 is mounted on the housing 126 of the heating portion 12. Such mounting may be effected by a screw, an adhesive, or any other suitable means. Accordingly, the temperature detector 13 rotates with the heating portion 12, and therefore detects the temperature of the fixing roller 111*a* at a predetermined position, that is, at a center portion of the fixing roller 111*a* in the axial direction of the fixing roller 111*a* constantly. Thus, the temperature detector 13 detects the temperature of the rotary heated member, that is, the fixing roller 111*a*, with improved accuracy.

A distance in a range of from about 20 mm to about 100 mm is provided between the thermopile element 131 of the temperature detector 13 and the fixing roller 111*a* of the pressing portion 11. The thermopile element 131 resists temperatures not greater than about 100 degrees centigrade. The surface temperature of the fixing roller 111*a* is in a range of from about 140 degrees centigrade to about 220 degrees centigrade during fixing operation. Accordingly, an electric current that flows in the coil loop 124 of the heating portion 12 is determined based on such temperatures. In order to prevent the heated fixing roller 111*a* from adversely affecting the thermopile element 131, the distance between the thermopile element 131 and the fixing roller 111*a* may be longer. For example, when the distance between the thermopile element 131 and the fixing roller 111*a* is not smaller than about 20 mm, the heated fixing roller 111*a* does not adversely affect the thermopile element 131. Further, when the distance between the thermopile element 131 and the fixing roller 111*a* is not greater than about 100 mm, no components other than the fixing roller 111*a* are within a detection range of the thermopile element 131. Accordingly, the thermopile element 131 detects the surface temperature of the fixing roller 111*a* precisely.

Figure 8A:
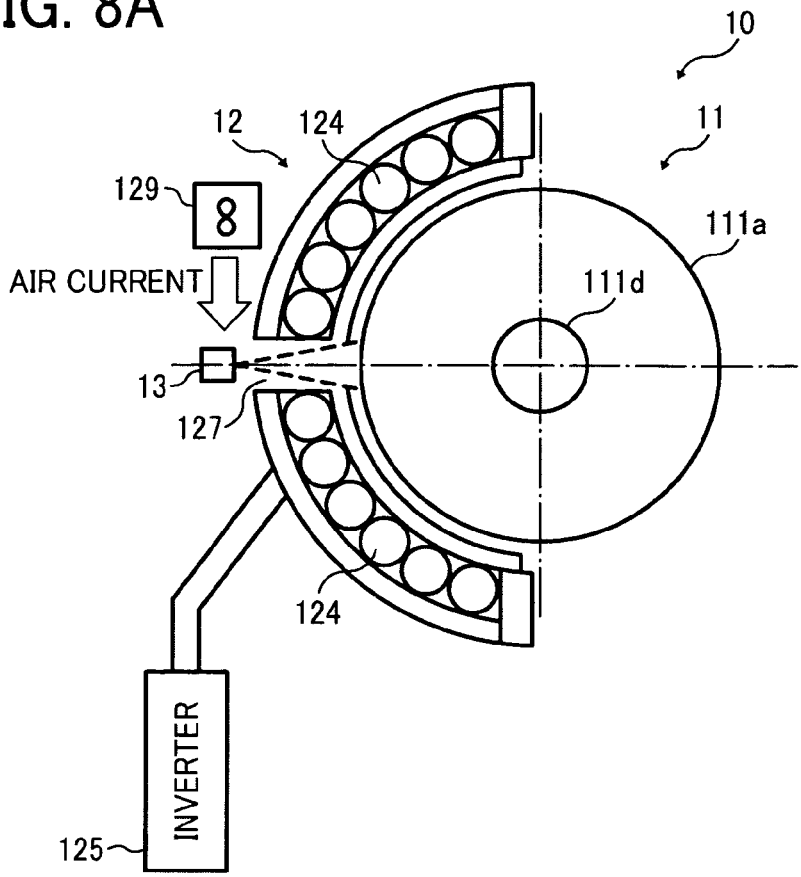
FIG. 8A is a partially enlarged sectional view (according to an example embodiment) of the fixing device shown in FIG. 7.
Figure 8B:
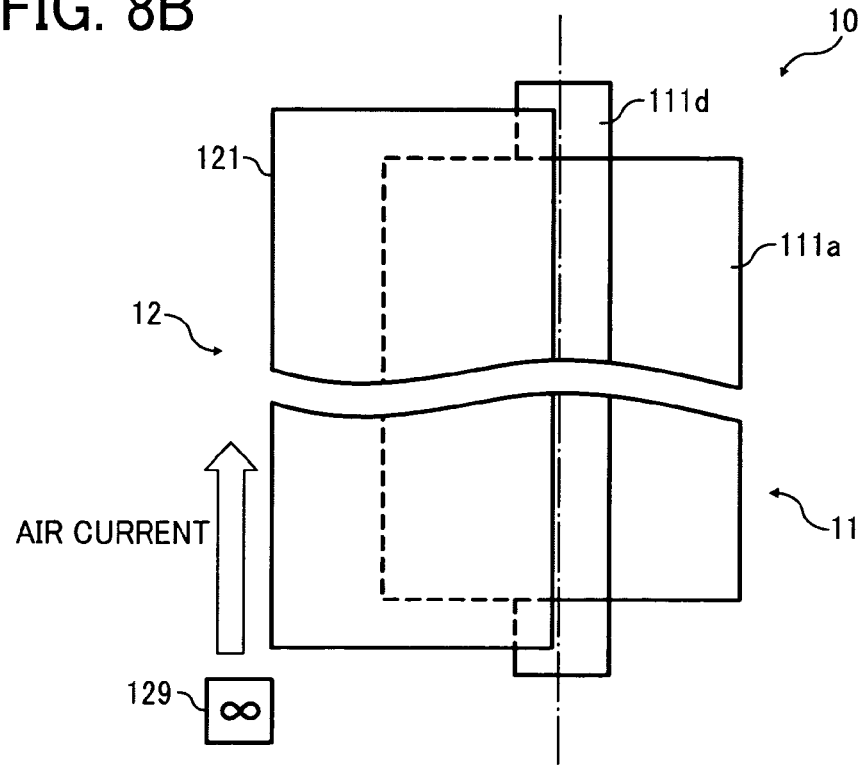
FIG. 8B is a plan view (according to an example embodiment) of the fixing device shown in FIG. 8A.

FIG. 8A is a partial sectional view of the fixing device 10. FIG. 8B is a partial plan view of the fixing device 10. As illustrated in FIG. 8A, the heating portion 12 further includes an inverter 125 and a fan 129.

The inverter 125 supplies power to the coil loop 124 serving as a magnetic flux generator. The fan 129 sends air to the temperature detector 13 that detects the temperature of the fixing roller 111*a* via the through-hole 127. Accordingly, air currents around the temperature detector 13 move in a vertical direction in FIG. 8A perpendicular to a horizontal direction in FIG. 8A in which the through-hole 127 extends toward the fixing roller 111*a*. The through-hole 127 extends in the horizontal direction in FIG. 8A. Therefore, the air currents move in the vertical direction as illustrated in FIG. 8A. Alternatively, the air currents may move in the axial direction of the fixing roller 111*a* as illustrated in FIG. 8B perpendicular to the horizontal direction in FIG. 8A in which the through-hole 127 extends. However, the air currents moving stably in the vertical direction as illustrated in FIG. 8A allow stable temperature detection of the temperature detector 13 with decreased fluctuation and stable temperature control.

Figure 9A:
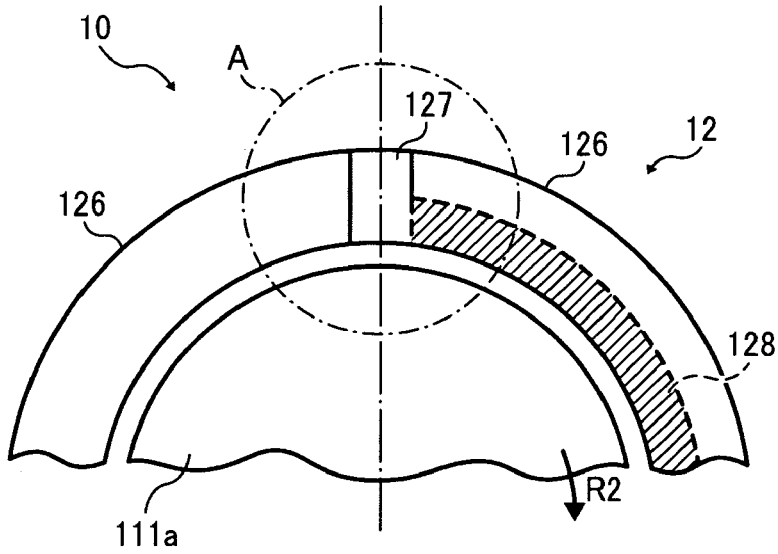
FIG. 9A is a partial sectional view (according to an example embodiment) of the fixing roller shown in FIG. 4 and the heating portion shown in FIG. 6A.
Figure 9B:
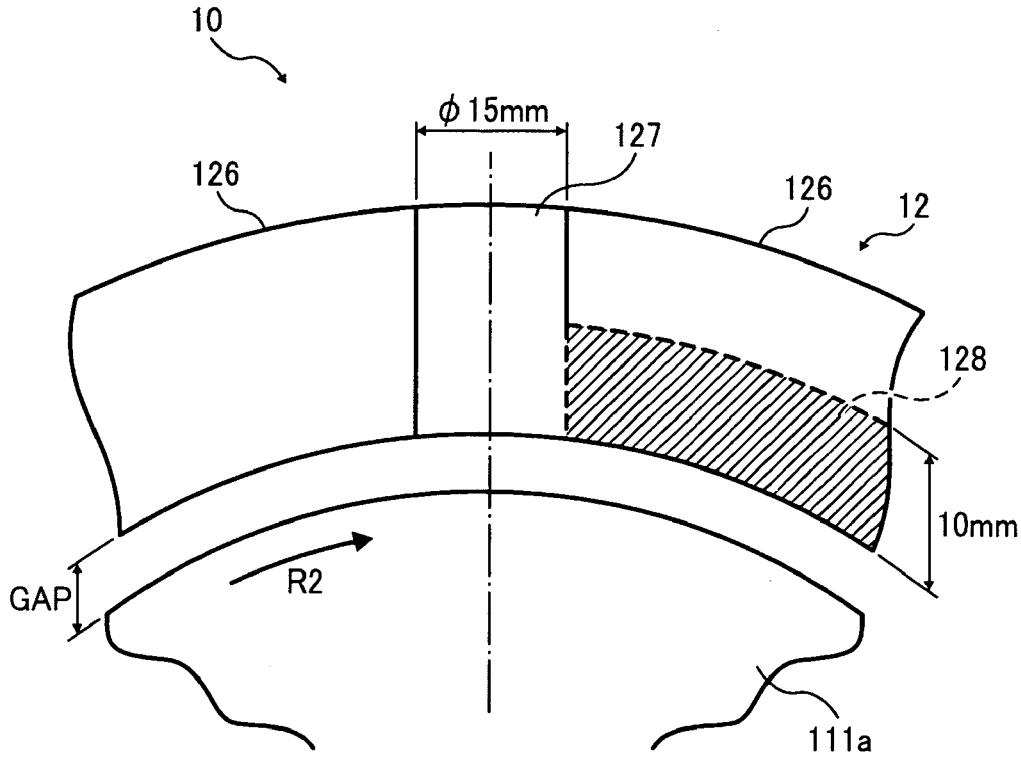
FIG. 9B is an enlarged sectional view (according to an example embodiment) of an area A of the fixing roller and the heating portion shown in FIG. 9A.

FIG. 9A is a partially sectional view of the fixing roller 111*a* and the heating portion 12 of the fixing device 10. FIG. 9B is an enlarged sectional view of an area A of the fixing device 10 shown in FIG. 9A. As illustrated in FIG. 9A, the heating portion 12 further includes a channel 128.

When the fixing roller 111*a* rotates, frictional resistance of the surface of the fixing roller 111*a* moves air currents in a gap between the coil loop 124 depicted in FIG. 7 and the fixing roller 111*a*, that is, a gap between the housing 126 of the induction heater 120 and the fixing roller 111*a*. The narrower the gap between the coil loop 124 and the fixing roller 111*a*, the more effectively the heating portion 12 generates an induction magnetic field to cause the fixing roller 111*a* to generate heat. In other words, the narrower the gap between the coil loop 124 and the fixing roller 111*a*, the better. However, according to this example embodiment, the gap between the coil loop 124 and the fixing roller 111*a*, that is, the gap between the housing 126 of the induction heater 120 and the fixing roller 111*a*, is about 2 mm to address production errors. Alternatively, the gap between the coil loop 124 and the fixing roller 111*a*, that is, the gap between the housing 126 of the induction heater 120 and the fixing roller 111*a*, may be set to a range of from about 0.5 mm to about 10.0 mm according to production errors to suppress loss of heat generation.

The air currents move from the through-hole 127 toward an outside of the through-hole 127 that has a negative pressure due to the air currents moving outside the heating portion 12. Accordingly, the air currents heated by the fixing roller 111*a* are cooled outside the heating portion 12, and cause condensation on the temperature detector 13 depicted in FIG. 7. Moreover, in the image forming apparatus 1, wax contained in toner is volatilized and adhered to an outer surface of a housing (e.g., the housing 126) of the fixing device 10.

To address these problems, the channel 128 is provided in the housing 126 at a position downstream from the through-hole 127 in a rotation direction R2 of the fixing roller 111*a*. The housing 126 is sandwiched between the fixing roller 111*a* and the coil loop 124. The housing 126 may be formed of resin. However, a portion of the housing 126 in which the through-holes 126*a* (depicted in FIG. 2) are provided may be formed of sheet metal. The channel 128 prevents the air currents moving in the gap between the coil loop 124 and the fixing roller 111*a*, that is, the air currents moving in the gap between the housing 126 of the induction heater 120 and the fixing roller 111*a*, from entering the through-hole 127 and exiting from the through-hole 127 to the outside of the through-hole 127. The channel 128 also discharges the air currents from the gap between the coil loop 124 and the fixing roller 111*a* to an outside of the fixing device 10 through an outlet of the channel 128. A hollow cross-sectional area of the channel 128 is greater than a hollow cross-sectional area of the through-hole 127. Accordingly, the air currents moving from the gap between the coil loop 124 and the fixing roller 111*a* provided upstream from the through-hole 127 in the rotation direction R2 of the fixing roller 111*a* do not move to an outside of the coil loop 124 through the through-hole 127, but move to the channel 128 provided downstream from the through-hole 127 in the rotation direction R2 of the fixing roller 111*a*.

Figure 10:
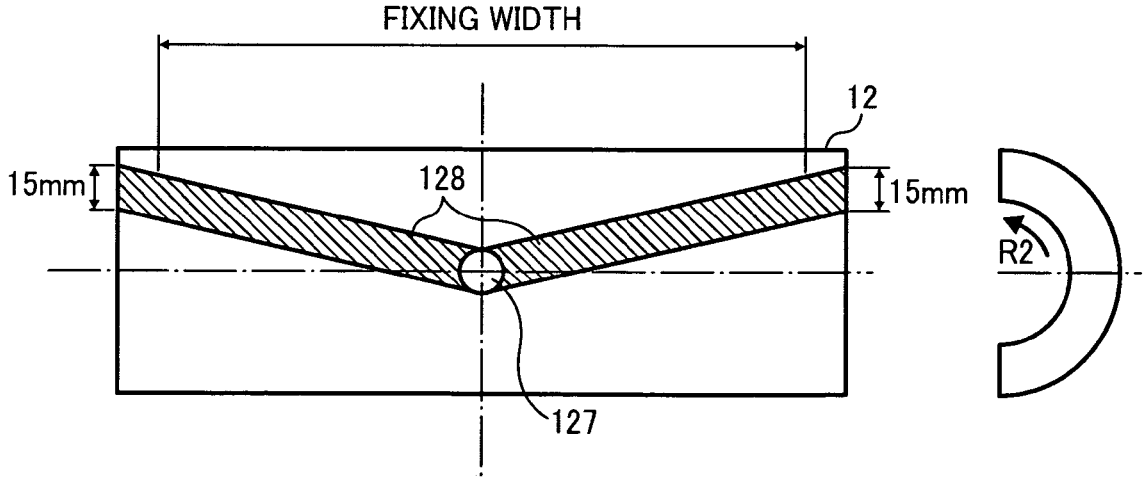
FIG. 10 is a side view (according to an example embodiment) of a channel included in the heating portion shown in FIG. 9B when the heating portion is seen from the fixing roller shown in FIG. 9B.

FIG. 10 is a side view of the channel 128 when the heating portion 12 is seen from the fixing roller 111*a*. The through-hole 127 is provided at a center of the housing 126 depicted in FIG. 9A, that is, a center of the induction heater 120 depicted in FIG. 3 of the heating portion 12 or a substantially center of the fixing device 10. The channel 128 extends symmetrically to either lateral side of the through-hole 127 in the axial direction of the fixing roller 111*a*. Accordingly, the gap between the coil loop 124 and the fixing roller 111*a*, that is, the gap between the housing 126 of the induction heater 120 and the fixing roller 111*a* extends symmetrically to either lateral side of the through-hole 127. Thus, the channel 128 provides, uniform temperature distribution of the fixing roller 111*a* in the axial direction of the fixing roller 111*a*.

As illustrated in FIG. 10, the hollow cross-sectional area of the channel 128 is unchanged throughout the length of the channel 128, that is, from a center portion connected to the through-hole 127 to lateral ends provided at lateral edges of the heating portion 12 in the axial direction of the fixing roller 111*a* depicted in FIG. 9B. Accordingly, the channel 128 moves the air currents to the outside of the heating portion 12 and the fixing device 10 to prevent condensation on the temperature detector 13 depicted in FIG. 7 and the fixing device 10 and adhesion of wax to the temperature detector 13 and the fixing device 10.

Alternatively, the hollow cross-sectional area of the channel 128 may become larger toward the lateral ends thereof. In other words, the hollow cross-sectional area of the channel 128 does not decrease toward the lateral ends thereof but increases. Accordingly, the air currents entering the channel 128 do not move into the through-hole 127, and therefore move through the channel 128, preventing condensation on the temperature detector 13 and adhesion of a foreign substance (e.g., wax) to the temperature detector 13.

The lateral ends of the channel 128 are disposed outside a fixing width of the fixing device 10, that is, an area of the fixing roller 111*a* corresponding to a width of a maximum recording sheet. According to this example embodiment, the fixing width is a long width of an A4-size recording sheet, that is, 297 mm. Alternatively, the fixing width may be a short width of an A4-size recording sheet, that is, 210 mm or an extended width of a recording sheet having extension margins. Namely, the lateral ends of the channel 128 may be provided outside a maximum width of an available recording sheet. Accordingly, even when the air currents cooled while passing through the channel 128 are liquefied and adhered to the fixing roller 111*a*, the fixing device 10 and the image forming apparatus 1 form a toner image on a recording sheet stably.

As illustrated in FIG. 9B, according to this example embodiment, the through-hole 127 has a circular shape with a diameter of 15 mm and a hollow cross-sectional area of 176.7 $mm^2$. On the other hand, the channel 128 has a groove shape with a depth of 10 mm, a width of 15 mm, and a cross-sectional area of 180.0 $mm^2$ when the gap between the coil loop 124 and the fixing roller 111*a* or the gap between the housing 126 of the induction heater 120 and the fixing roller 111*a* is 2 mm. Accordingly, the groove having the channel 128 is provided downstream from the through-hole 127 in the rotation direction R2 of the fixing roller 111*a*. Consequently, the air currents entering the gap between the coil loop 124 and the fixing roller 111*a* move to the channel 128 provided downstream from the through-hole 127 in the rotation direction R2 of the fixing roller 111*a* and having the hollow cross-sectional area larger than the hollow cross-sectional area of the through-hole 127.

With the above-described simple structure, in the fixing device 10, 10S, or 10T, the through-hole 127 and the channel 128 suppress air currents flowing out of the through-hole 127 of the heating portion 12 to prevent a foreign substance from adhering to the temperature detector 13. Further, the through-hole 127 and the channel 128 prevent faulty temperature detection of the temperature detector 13 that detects the temperature of the fixing roller 111*a* to provide stable temperature control of the fixing roller 111*a*. The channel 128 extends symmetrically to either lateral side of the through-hole 127 in the axial direction of the rotary heated member (e.g., the fixing roller 111*a*, the heating roller 111*b*, or the fixing belt 111*c*) to provide uniform temperature distribution. Accordingly, the fixing device 10, 10S, or 10T including the through-hole 127 and channel 128 provides stable fixing performance without faulty fixing. Further, the image forming apparatus 1 including the fixing device 10, 10S, or 10T provides stable image forming performance.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A heating device for heating a rotary heated member that rotates in a predetermined direction of rotation, the heating device comprising:

a heater facing the rotary heated member without contacting the rotary heated member to heat the rotary heated member; and a temperature detector facing the rotary heated member via the heater to detect a temperature of the rotary heated member, the heater comprising:

a housing provided between the temperature detector and the rotary heated member;

a through-hole provided in the housing, via which the temperature detector faces the rotary heated member; and a channel provided in the housing at a position downstream from the through-hole in the direction of rotation of the rotary heated member, through which an air current generated in a gap between the heater and the rotary heated member moves, the channel having a hollow cross-sectional area greater than a hollow cross-sectional area of the through-hole.

2. The heating device according to claim 1, wherein the through-hole extends in a direction perpendicular to an axial direction of the rotary heated member, and an air current around the temperature detector moves in a direction perpendicular to the direction in which the through-hole extends.

3. The heating device according to claim 1, wherein the heater further comprises an exciting coil formed in a loop facing the rotary heated member via the housing to heat the rotary heated member, and wherein the through-hole is provided inside the loop formed by the exciting coil.

4. The heating device according to claim 1, wherein the through-hole is provided at a center of the heater in an axial direction of the rotary heated member, and the channel extends symmetrically to either lateral side of the through-hole in the axial direction of the rotary heated member.

5. The heating device according to claim 4, wherein the hollow cross-sectional area of the channel is unchanged throughout the length of the channel.

6. The heating device according to claim 4, wherein the hollow cross-sectional area of the channel increases away from the through-hole in the axial direction of the rotary heated member.

7. A fixing device for fixing a toner image on a recording medium, comprising:

a pressing portion to contact the recording medium bearing the toner image to apply heat and pressure to the recording medium bearing the toner image, comprising a rotary heated member that rotates in a predetermined direction of rotation; and a heating portion facing the pressing portion to heat the rotary heated member of the pressing portion, the heating portion comprising the heating device according to claim 1.

8. The fixing device according to claim 7, wherein lateral ends of the channel in an axial direction of the rotary heated member are disposed outside an area of the rotary heated member corresponding to a width of the recording medium passing through the pressing portion.

9. An image forming apparatus comprising:

an image carrier to carry an electrostatic latent image;

a development device facing the image carrier to make the electrostatic latent image carried on the image carrier visible as a toner image;

a transfer device facing the image carrier to transfer the toner image formed on the image carrier onto a recording medium; and a fixing device according to claim 7, provided downstream from the transfer device in a recording medium conveyance direction to fix the toner image on the recording medium.

* * * * *